US010692475B2

(12) United States Patent
Ishizaka

(10) Patent No.: US 10,692,475 B2
(45) Date of Patent: Jun. 23, 2020

(54) BODY FOR STRINGED INSTRUMENT AND STRINGED INSTRUMENT

(71) Applicant: YAMAHA CORPORATION, Hamamatsu-shi (JP)

(72) Inventor: Kenta Ishizaka, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/354,713

(22) Filed: Mar. 15, 2019

(65) Prior Publication Data

US 2019/0295512 A1 Sep. 26, 2019

(30) Foreign Application Priority Data

Mar. 20, 2018 (JP) ..... 2018-053405

(51) Int. Cl.
*G10D 1/08* (2006.01)
*G10D 3/02* (2006.01)

(52) U.S. Cl.
CPC ..... *G10D 1/085* (2013.01); *G10D 1/08* (2013.01); *G10D 3/02* (2013.01)

(58) Field of Classification Search
CPC ..... G10D 1/085; G10D 1/08; G10D 3/02
See application file for complete search history.

(56) References Cited

U.S. PATENT DOCUMENTS 3,910,151 A * 10/1975 Copeland ..... G10D 1/08 84/267
5,339,718 A * 8/1994 Leduc ..... G10D 1/085 84/275
6,198,031 B1 * 3/2001 Jones ..... G10D 1/085 224/910
6,255,567 B1 * 7/2001 Minakuchi ..... G10D 1/085 84/291
6,359,208 B1 * 3/2002 Farnell, Jr. ..... G10D 1/005 84/267
6,888,054 B2 * 5/2005 Minakuchi ..... G10D 1/085 84/267
6,911,590 B2 * 6/2005 Childress ..... G10D 1/00 84/291
7,002,065 B2 * 2/2006 Petersen ..... G10D 1/085 84/290
7,507,885 B2 * 3/2009 Coke ..... G10D 1/085 84/267
7,538,269 B2 * 5/2009 Ekstrom ..... G10D 1/085 84/718

(Continued)

FOREIGN PATENT DOCUMENTS

WO 2018168690 A1 9/2018

OTHER PUBLICATIONS

"REVSTAR" Yamaha Corporation. [online] Internet<https://jp.yamaha.com/products/musical_instruments/guitars_basses/el_guitars/rs/index.html> retrieved on Feb. 26, 2018. English translation provided.

(Continued)

*Primary Examiner* — Robert W Horn
(74) *Attorney, Agent, or Firm* — Rossi, Kimms & McDowell LLP

(57) ABSTRACT

A body for a stringed instrument includes a body unit having a protrusion, and a rigidity adjusting member that extends from a central portion of the body unit and that is affixed to the body unit.

10 Claims, 4 Drawing Sheets

(56) References Cited

U.S. PATENT DOCUMENTS

| | | | | |
|---|---|---|---|---|
| 7,598,444 | B2 * | 10/2009 | Farnell, Jr. | B29C 44/12 84/291 |
| 8,378,192 | B1 * | 2/2013 | Harmon | G10D 1/085 84/291 |
| 8,975,502 | B1 * | 3/2015 | Delgado | G10H 3/185 84/290 |
| 9,000,282 | B1 * | 4/2015 | Booth | G10D 3/02 84/291 |
| 9,111,511 | B2 * | 8/2015 | Miller | G10D 1/085 |
| 9,165,539 | B2 * | 10/2015 | Ostosh | G10D 1/085 |
| 9,424,816 | B2 * | 8/2016 | Saito | G10D 3/00 |
| 9,502,006 | B1 | 11/2016 | Galloup | |
| 9,520,108 | B1 * | 12/2016 | Powers | G10D 3/02 |
| 9,607,588 | B2 * | 3/2017 | Austin | G10D 1/005 |
| 9,911,401 | B2 * | 3/2018 | Austin | G10D 1/005 |
| 9,966,049 | B2 * | 5/2018 | Kung | G10D 1/085 |
| 2005/0211052 | A1 * | 9/2005 | Gigliotti | G10D 1/085 84/290 |
| 2007/0163420 | A1 * | 7/2007 | Reiss | G10D 1/085 84/329 |
| 2008/0202309 | A1 * | 8/2008 | Wiswell | G10D 1/085 84/291 |
| 2009/0183618 | A1 | 7/2009 | Luttwak | |
| 2011/0005366 | A1 | 1/2011 | Gillett | |
| 2012/0097007 | A1 | 4/2012 | Barillaro | |
| 2013/0283995 | A1 * | 10/2013 | Gorman | G10D 3/02 84/294 |
| 2016/0372089 | A1 * | 12/2016 | Tully | G10D 1/085 |
| 2019/0295512 | A1 * | 9/2019 | Ishizaka | G10D 1/08 |

OTHER PUBLICATIONS

Extended European Search Report issued in EP Appln. No. 19163231.4 dated Jul. 25, 2019.

* cited by examiner

BODY FOR STRINGED INSTRUMENT AND STRINGED INSTRUMENT

BACKGROUND OF THE INVENTION

Field of the Invention

Priority is claimed on Japanese Patent Application No. 2018-53405, filed Mar. 20, 2018, the content of which is incorporated herein by reference.

Description of Related Art

The present invention relates to a body for a stringed instrument and a stringed instrument provided with the body.

A stringed instrument such as an electric guitar is provided with a body, a neck, and a head. In such a stringed instrument, vibration of a string is also transmitted to the body and the neck, with the body and neck also vibrating. The vibration energy of the string is consumed by the vibration of the body and the neck, whereby the vibration of the string is attenuated. For this reason, the vibration characteristics of the body and the neck influence the vibration of the string and the sound quality of the stringed instrument.

"REVSTAR" [online], [retrieved on Feb. 26, 2018] Retrieved from Internet <URL: https://jp.yamaha.com/products/musical_instruments/guitars_basses/el_guitars/rs/index.html> discloses an electric guitar that includes a body that has been subjected to a cutaway process removing a portion of the body in order to make the electric guitar easy to play. In the body subjected to the cutaway process, the portions not cut away are formed as protrusions.

In this way, when protrusions are formed on the body in consideration of playability and the appearance design of the stringed instrument, the vibration characteristics of the body differ compared with the case where protrusions are not formed. Therefore, in a stringed instrument having a body in which protrusions are formed, there is room for improving the vibration characteristics of the body and for improving the sound quality.

The present invention was achieved in view of the above circumstances, and has as its object to provide a body for a stringed instrument that can improve sound quality even when protrusions are formed, and a stringed instrument provided with the same body.

SUMMARY OF THE INVENTION

A body for a stringed instrument according to the present invention is provided with a body unit having a protrusion, and a rigidity adjusting member that extends from a central portion of the body unit and that is affixed to the body unit.

A body for a stringed instrument according to the present invention is provided with a body unit having a protrusion, and a rigidity adjusting member that is affixed to the body unit and that suppresses bending deformation of the protrusion in the body unit.

A stringed instrument according to the present invention is provided with either of the aforementioned bodies.

DETAILED DESCRIPTION OF THE INVENTION

A preferred embodiment of the present invention will be described in detail hereinbelow with reference to FIGS. 1 to 6. In the present embodiment, an electric guitar 1 is represented as an example of a stringed instrument according to the present invention.

Figure 1:
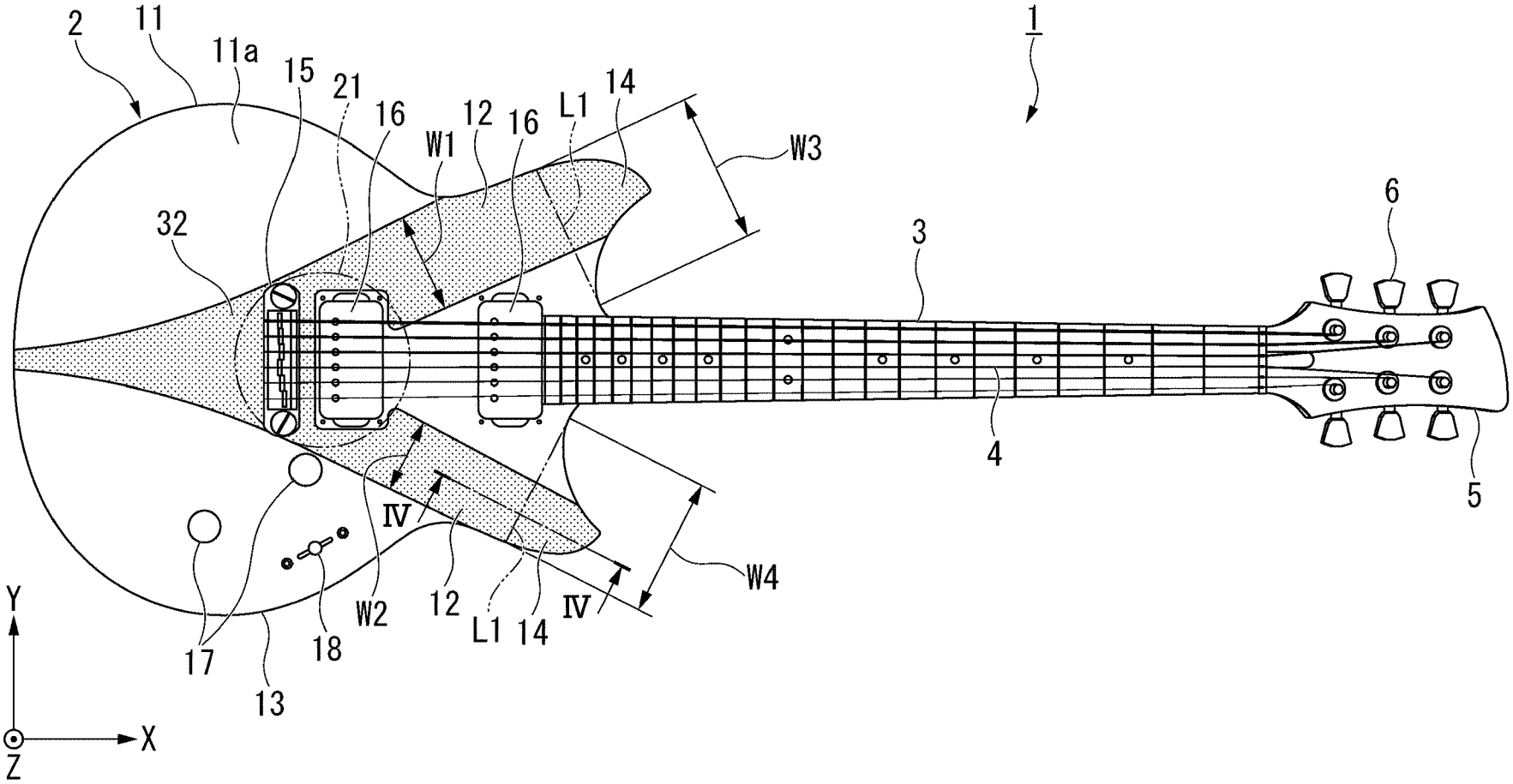
FIG. 1 is a front view showing a stringed instrument according to an embodiment of the present invention.

As shown in FIG. 1, the electric guitar 1 according to the present embodiment includes a body 2, a neck 3, and a string 4.

The neck 3 is connected to an end portion of the body 2 and extends from the body 2 in the X-axis direction of FIG. 1. A head 5 forming a distal end of the neck 3 in the lengthwise direction is provided with a tuning peg 6 onto which one end of a string 4 is wound. The string 4 is stretched along the lengthwise direction (string tensing direction, X-axis direction) of the neck 3.

The body 2 of the electric guitar 1 includes a body unit 11 and a rigidity adjusting member 12.

The body unit 11 is made of a solid body with no hollow portions inside. That is, the body unit 11 is formed in a plate shape. The body unit 11 is made of wood such as alder, maple, or mahogany. For example, the body unit 11 may also be constituted by combining two or more kinds of different wood materials.

In the following description, the lengthwise direction (string tensing direction, X-axis direction) of the neck 3, which is a direction orthogonal to the thickness direction (Z-axis direction) of the body unit 11, is referred to as the lengthwise direction of the body unit 11. A direction (Y-axis direction) orthogonal to both the thickness direction and the lengthwise direction of the body unit 11 is referred to as the width direction of the body unit 11.

The body unit 11 has a main body 13 and two protrusions 14 that are formed integrally.

The main body 13 is formed in a plate shape and constitutes a major portion of the body unit 11. The main body 13 is connected to the neck 3 at a first end in the lengthwise direction. A connecting portion between the main body 13 and the neck 3 is located at an intermediate portion in the width direction of the main body 13. In the present embodiment, the length of the main body 13 in the lengthwise direction is longer than the length of the main body 13 in the width direction.

A bridge 15, an electromagnetic pickup 16, and controllers are mounted on a surface of the main body 13. The bridge 15, the electromagnetic pickup 16, and the controllers are mounted on a front surface 11*a* of the body unit 11 in the thickness direction (Z-axis direction).

The bridge 15 is located at a central portion in the width direction of the main body 13. One end of the string 4 is held at the bridge 15. The electromagnetic pickup 16 is positioned between the neck 3 and the bridge 15 in the lengthwise direction of the main body 13. In the present embodiment, two electromagnetic pickups 16 are arranged side by side in the lengthwise direction of the main body 13. The controllers adjust the volume, tone, and the like of a sound signal output from the electromagnetic pickup 16. The controllers include two volume switches 17 and a pickup selector 18 for switching the electromagnetic pickup 16 to be operated.

The body unit 11 includes two protrusions 14 protruding from an edge of the main body 13. Specifically, the protrusions 14 protrude in a direction orthogonal to the thickness direction of the main body 13 from an edge of the main body 13 (a portion indicated by an imaginary line L1 in FIG. 1). The thickness of the protrusions 14 in the Z-axis direction is equal to the thickness of the main body 13. Widths W3 and W4 of the protrusions 14 in the XY plane are formed in a shape that gradually decreases in the protrusion direction of each of the protrusions 14.

In the body unit 11 of the present embodiment, the two protrusions 14 are formed spaced apart from each other. Although the number of the protrusions 14 in the present embodiment is two, the number is not limited thereto, and there may be one or three or more.

In the present embodiment, the two protrusions 14 are positioned at the first end portion of the main body 13 in the lengthwise direction. The two protrusions 14 are also positioned at both ends of the main body 13 in the width direction. That is, the two protrusions 14 are arranged with a space therebetween, sandwiching the neck 3 in the width direction of the main body 13.

When vibration is applied to the body unit 11 constituted as described above, a predetermined vibration mode is excited in the body unit 11 at a predetermined natural frequency.

Figure 2:
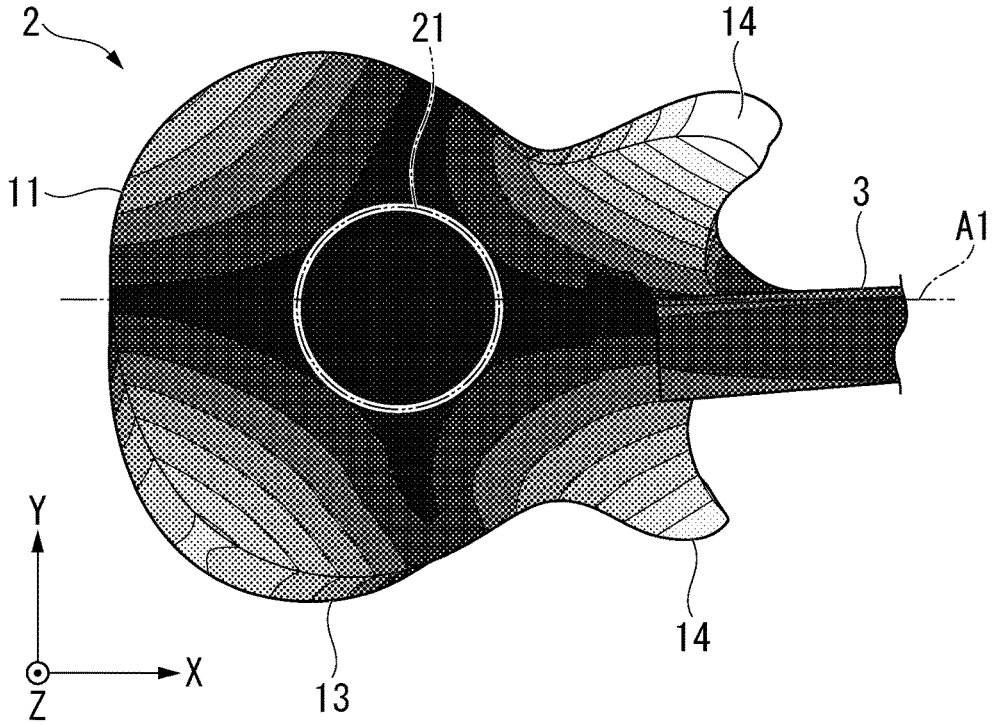
FIG. 2 is a drawing showing an example of vibration in a body of the stringed instrument of FIG. 1 when the body vibrates in a "torsional mode."

FIG. 2 shows vibration in the body unit 11 that is excited in a "torsional mode" in which the body unit 11 vibrates so as to be twisted about an axis A1 of the body unit 11 extending in the lengthwise direction of the body unit 11. In the grayscale of FIG. 2, a whiter portion indicates a greater vibration displacement, while a blacker portion indicates a smaller vibration displacement.

A portion of the body unit 11 where the vibration displacement is large corresponds to an antinode of a standing wave in a "torsional mode" (hereinafter referred to as a torsional mode antinode). In the present embodiment, as shown in FIG. 2, four portions located at both ends in the lengthwise direction of the body unit 11 and at both ends in the width direction of the body unit 11 correspond to torsional mode antinodes. In this embodiment, of those four portions, vibration displacement at the two portions where the protrusions 14 are formed is greater than the vibration displacement at the other two portions.

On the other hand, a portion of the body unit 11 where there is no displacement or where the vibration displacement is small, which is indicated by the color black in the drawing, corresponds to a node of a standing wave in the "torsional mode" (hereinafter referred to as a torsional mode node). In the present embodiment, as shown in FIG. 2, a central portion 21 of the body unit 11 located mainly in the middle of the body unit 11 in the lengthwise direction and in the middle of the body unit 11 in the width direction corresponds to the torsional mode node.

Figure 3:
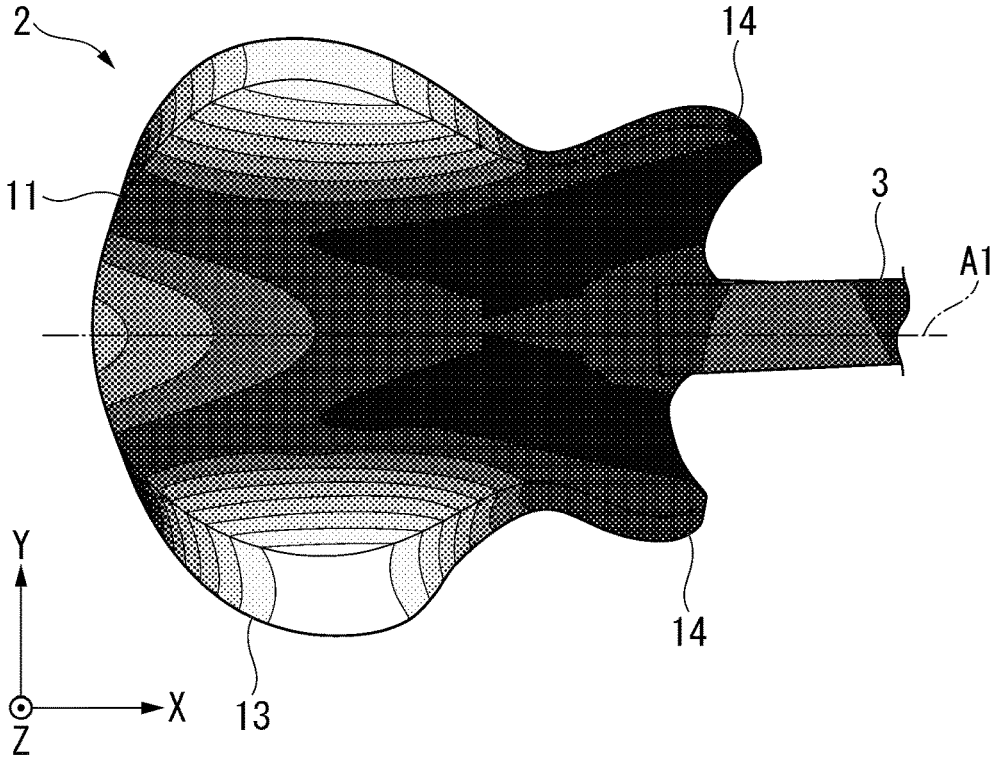
FIG. 3 is a drawing showing an example of vibration in the body of the stringed instrument of FIG. 1 when the body vibrates in a "bending mode."

FIG. 3 shows vibration in the body unit 11 that is excited in a "bending mode" in which the body unit 11 vibrates so as to curve in the width direction around an axis A1 of the body unit 11. In the grayscale of FIG. 3, a whiter portion indicates a greater vibration displacement, while a blacker portion indicates a smaller vibration displacement.

A portion of the body unit 11 where the vibration displacement is large, which is indicated by the color white, corresponds to an antinode of a standing wave in a "bending mode" (hereinafter referred to as a bending mode antinode). In the present embodiment, as shown in FIG. 3, bending mode antinodes are positioned at both ends of the body unit 11 in the width direction, particularly both ends of the body unit 11 in the width direction located on a second end portion side of the body unit 11 in the lengthwise direction. The second end portion of the body unit 11 is an end portion located on the side opposite to the first end portion of the body unit 11 in the lengthwise direction of the body unit 11.

On the other hand, a portion of the body unit 11 where there is no displacement or where the vibration displacement is small, which is indicated by the color black, corresponds to a node of a standing wave in the "bending mode" (hereinafter referred to as a bending mode node). In the present embodiment, as shown in FIG. 3, the bending mode node is positioned in the middle of the body unit 11 in the width direction.

Referring again to FIG. 1, the rigidity adjusting member 12 is affixed to the body unit 11 so as to adjust the rigidity of the body unit 11 in order to change the aforementioned vibration characteristics of the body unit 11, in particular the frequency characteristic of vibration. That is, the rigidity adjusting member 12 is affixed to the body unit 11 so as to suppress bending deformation of the protrusions 14 of the body unit 11. Specifically, the rigidity adjusting member 12 extends from the central portion 21 of the body unit 11 to each of the protrusions 14. The central portion 21 of the body unit 11 is located in the main body 13 of the body unit 11. In FIG. 1, the rigidity adjusting members 12 are indicated by dotted hatching.

In the present embodiment, the above-described torsional mode node is located at the central portion 21 of the body unit 11. A distal ends of the rigidity adjusting member 12 in the extension direction thereof should at least reach the protrusion 14. The distal ends of the rigidity adjusting member 12 need not for example reach the distal end of the protrusion 14 in the projecting direction thereof. In the present embodiment, the distal end of the rigidity adjusting member 12 reaches the distal end of the protrusion 14 in the projecting direction thereof.

Figure 4:
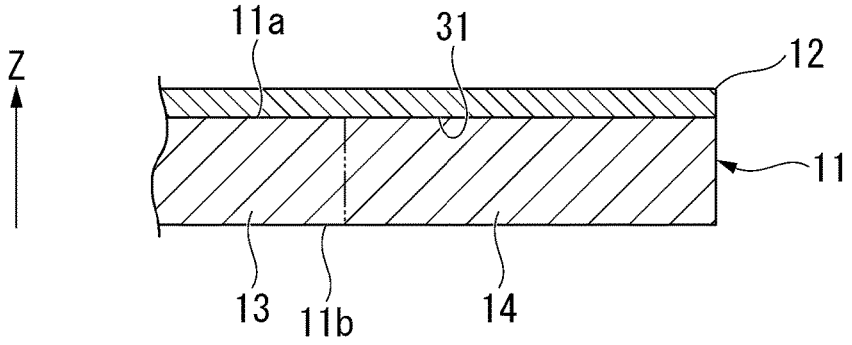
FIG. 4 is a cross-sectional view at arrows IV-IV of FIG. 1.

As shown in FIGS. 1 and 4, the rigidity adjusting member 12 has a contact surface 31 for making contact with the body unit 11. The entire contact surface 31 of the rigidity adjusting member 12 contacts and is affixed to the body unit 11. For example, the fixing surface of the body unit 11 with which the contact surface 31 of the rigidity adjusting member 12 makes contact may be a back surface 11*b* of the body unit 11. The fixing surface of the body unit 11 in the present embodiment is the front surface 11*a* of the body unit 11. The rigidity adjusting member 12 should be affixed to the front surface 11*a* of the body unit 11 by bonding or the like, rather than by screw fastening at a plurality of places. That is, the rigidity adjusting member 12 should be affixed to the body unit 11 over a surface rather than being fixed at points.

In the present embodiment, the rigidity adjusting member 12 is formed in a band shape extending from the central portion 21 of the body unit 11 to the protrusion 14. The contact surface 31 of the rigidity adjusting member 12 is a surface facing in the plate thickness direction of the rigidity adjusting member 12.

The specific rigidity of the rigidity adjusting member 12 is higher than that of the body unit 11. The rigidity adjusting member 12 of the present embodiment is made of a fiber-reinforced member containing fibers harder than the body unit 11. A direction of the fibers (lengthwise direction of the fibers) is oriented in the extension direction of the rigidity adjusting member 12 in the X-Y plane (that is, in the direction from the central portion 21 of the body unit 11 to the protrusion 14 in FIG. 1). While the direction of the fibers may completely agree with the extension direction of the rigidity adjusting member 12, the direction may also may be somewhat inclined with respect to the extension direction, for example. That is, provided the fiber direction is at least not perpendicular to the extension direction of the rigidity adjusting member 12, the direction is not particularly limited. The fiber-reinforced member constituting the rigidity adjusting member 12 may be made of carbon fiber reinforced plastic (CFRP) or the like containing carbon fibers, for example. Constituting the rigidity adjusting member 12 with a fiber-reinforced member enables a reduction in weight of the rigidity adjusting member 12.

In the X-Y plane, widths W1 and W2 of the respective rigidity adjusting members 12, which are orthogonal to the extension direction of the rigidity adjusting members 12, may be equal to or greater than half of the widths W3 and W4 of the protrusions 14 and equal to or less than the widths W3 and W4.

The body 2 of the present embodiment is provided with two rigidity adjusting members 12. The two rigidity adjusting members 12 respectively extend to the two protrusions 14. That is, the number of the rigidity adjusting members 12 is the same as the number of the protrusions 14.

The two rigidity adjusting members 12 may for example be formed separately. In the present embodiment, the two rigidity adjusting members 12 are integrally formed. The two rigidity adjusting members 12 are joined to each other by a connecting portion 32 at the center portion 21 of the body unit 11 (the torsional mode node).

As described above, the two protrusions 14 in the body unit 11 of the present embodiment are positioned at the first end of the main body 13 in the lengthwise direction. Therefore, each of the rigidity adjusting members 12 extends from the central portion 21 of the main body 13 (the torsional mode node) toward the first end side of the main body 13.

Further, at the first end of the main body 13, the two protrusions 14 are positioned at both ends in the width direction of the main body 13. Therefore, heading in the lengthwise direction of the main body 13 from the central portion 21 of the main body 13 toward the first end, the rigidity adjusting members 12 each extend in a sloping manner so as to approach both ends in the width direction of the main body 13. As a result, the rigidity adjusting members 12 form a V shape as a whole.

In addition, the rigidity adjusting members 12 are formed so as not to extend from the central portion 21 of the main body 13 (the torsional mode node) toward the bending mode antinodes of the main body 13. Specifically, the rigidity adjusting members 12 are not provided at portions of the main body 13 at both ends in the width direction adjacent to the central portion 21 of the main body 13, and at portions adjacent to those ends on the second end side in the lengthwise direction.

Figure 6:
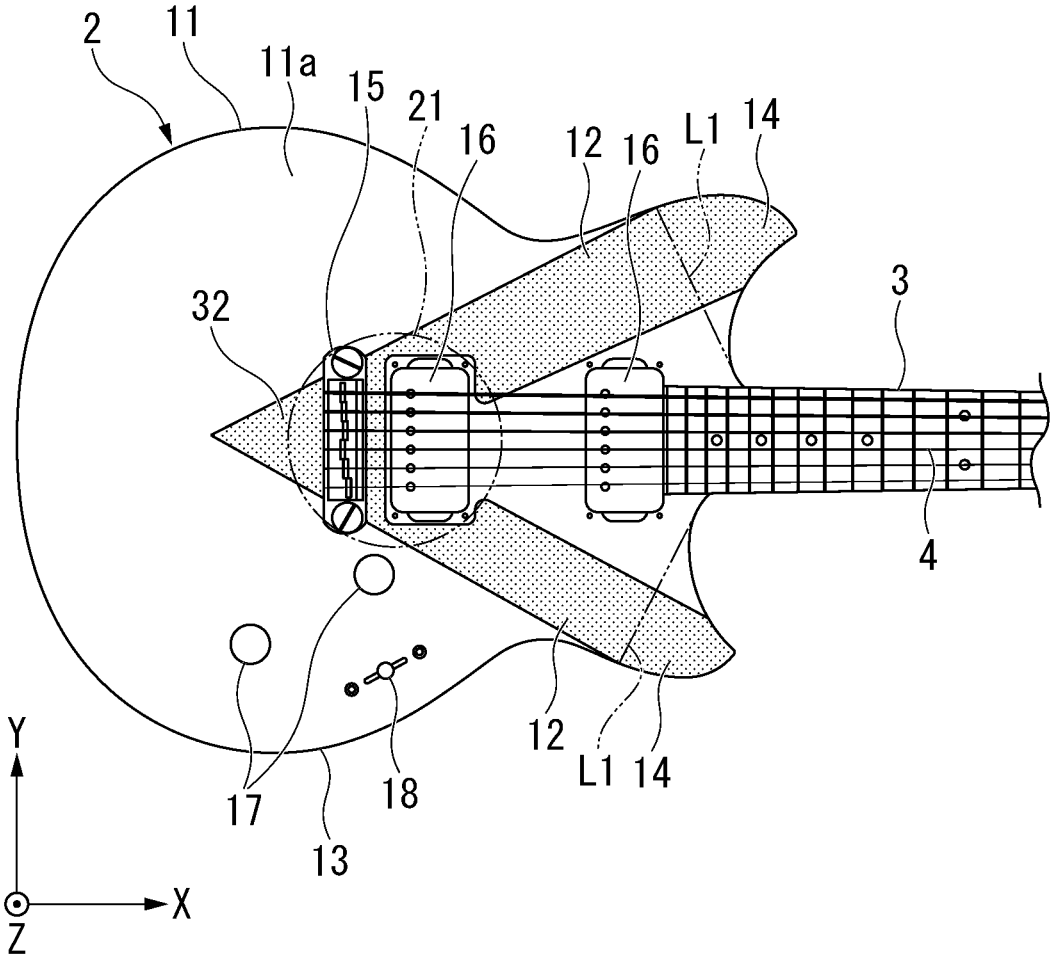
FIG. 6 is a front view showing a modification example of the rigidity adjusting member in the stringed instrument of FIG. 1.

As illustrated in FIG. 1, the connecting portion 32 of the two rigidity adjusting members 12 extends toward the second end side in the lengthwise direction of the main body 13 and reaches the second end. In this case, the width of the connecting portion 32 in the Y-axis direction is preferably small enough not to protrude from the bending mode node of the main body 13 (the center portion in the width direction of the main body 13). As shown in FIG. 6, the connecting portion 32 may also be positioned apart from the second end of the main body 13 so as not to reach the second end of the main body 13. The connecting portion 32 may also be located only in the central portion 21.

Figure 5:
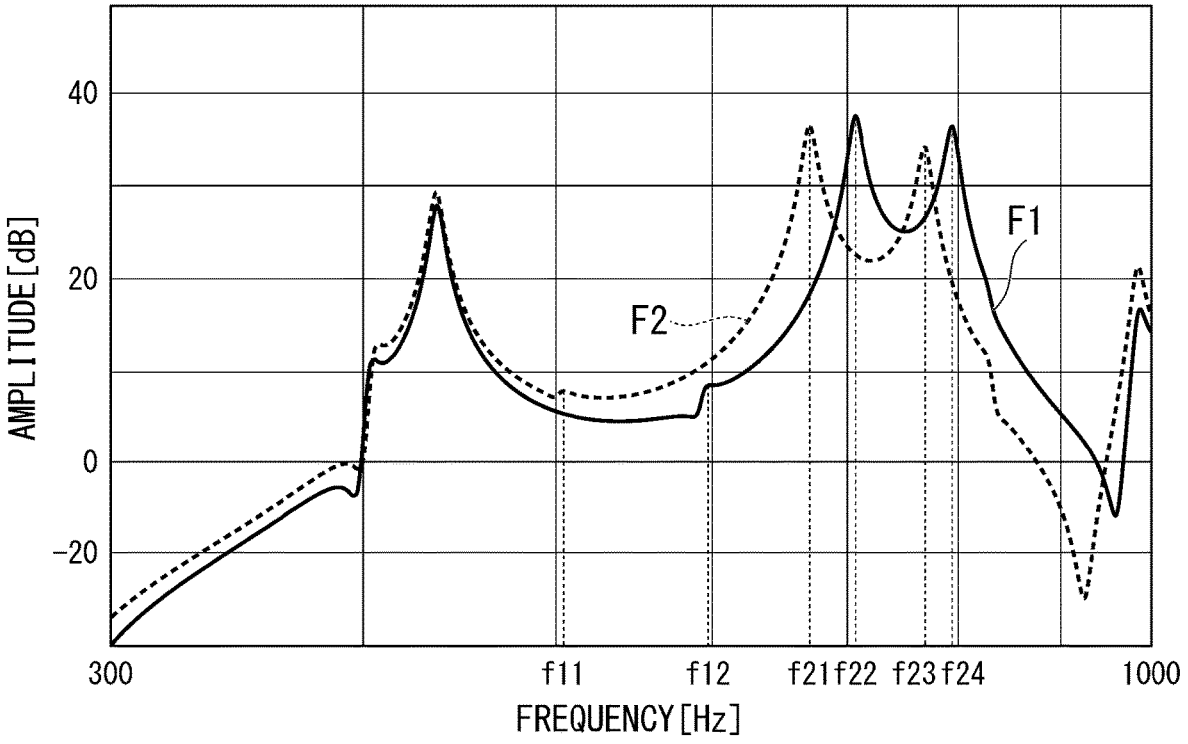
FIG. 5 is a graph showing the frequency characteristic of vibration in the body for a stringed instrument according to FIG. 1, and the frequency characteristic of vibration in a body that does not include a rigidity adjusting member.

The body 2 of the electric guitar 1 of the present embodiment configured as described above has the vibration frequency characteristic shown by the solid line F1 in FIG. 5. The broken line F2 in FIG. 5 shows the vibration frequency characteristic in the body of a comparative example that does not have the rigidity adjusting member 12.

In a body of the comparative example, vibration in the torsional mode occurs at natural frequency f11, and vibration in the bending mode occurs at natural frequencies f21 and f23. On the other hand, in the body 2 of the embodiment, vibration in the torsional mode occurs at natural frequency f12, and vibration in the bending mode occurs at natural frequencies f22 and f24.

As shown in FIG. 5, the natural frequency f12 corresponding to the torsional mode in the body 2 of the embodiment is higher than the natural frequency f11 corresponding to the torsional mode in the body of the comparative example. That is, attaching the rigidity adjusting member 12 to the body unit 11 has the effect of raising the natural frequency corresponding to the torsional mode.

In addition, two natural frequencies f22, f24 corresponding to the bending mode in the body 2 of the embodiment are higher than two respective natural frequencies f21, f23 corresponding to the bending mode in the body of the comparative example. That is, attaching the rigidity adjusting members 12 to the body unit 11 has the effect of raising the natural frequencies corresponding to the bending mode.

However, the respective differentials between the two natural frequencies f22, f24 corresponding to the bending mode in the embodiment and the two natural frequencies f21, f23 corresponding to the bending mode in the comparative example are smaller than the differential between the natural frequency f12 corresponding to the torsional mode in the embodiment and the natural frequency f11 corresponding to the torsional mode in the comparative example. This is because the rigidity adjusting member 12 of the present embodiment extends from the torsional mode node of the body unit 11 toward the torsional mode antinodes (protrusions 14), but does not extend from the bending mode node toward the bending mode antinodes.

As described above, the rigidity adjusting member 12 can change the vibration characteristic (vibration frequency characteristic) of the body 2 of the embodiment with respect to the vibration characteristic of the body of the comparative example. Therefore, the rigidity adjusting member 12 can improve the sound quality of the electric guitar 1 having the body 2 of the embodiment compared to the sound quality of an electric guitar having the body of the comparative example.

As described above, the body 2 of the electric guitar 1 of the present embodiment is provided with the rigidity adjusting member 12 extending from the torsional mode node (the central portion 21) located in the main body 13 to the protrusion 14. In addition, the entire contact surface 31 of the rigidity adjusting member 12 is affixed to the fixing surface (surface 11*a*) of the body unit 11. Therefore, bending deformation of the protrusion 14 with respect to the main body 13 is suppressed, and so the rigidity of the body 2 can be partially increased. As a result, as shown in FIG. 5, the natural frequency of the body 2 vibrating in a predetermined vibration mode (torsional mode, bending mode) can be increased. Accordingly, the vibration characteristic of the body 2 can be improved by the rigidity adjusting member 12, and the sound quality of the electric guitar 1 can be improved.

In the body 2 of the electric guitar 1 of the present embodiment, the rigidity adjusting member 12 is made of a fiber-reinforced member containing fibers harder than the body unit 11. Moreover, the fiber direction is oriented in the extension direction of the rigidity adjusting member 12. Therefore, it is possible to effectively suppress bending deformation of the protrusion 14 with respect to the main body 13 while reducing the weight of the rigidity adjusting member 12. Thereby, the natural frequency of the body 2 corresponding to a predetermined vibration mode (torsional mode, bending mode) can be further increased.

Further, in the body 2 of the electric guitar 1 of the present embodiment, by changing the rigidity of the rigidity adjusting member 12 and the hardness of the fibers of the fiber-reinforced member constituting the rigidity adjusting member 12, it is possible to adjust the degree of suppressing bending deformation of the protrusion 14 with respect to the main body 13 (the rigidity of the body 2 and the degree of increase in the natural frequency of the body 2).

Further, in the body 2 of the electric guitar 1 of the present embodiment, a plurality of the rigidity adjusting members 12 respectively extend to a plurality of the protrusions 14. Therefore, even if the body 11 has a plurality of the protrusions 14, it is possible to suppress bending deformation of the protrusions 14 with respect to the main body 13 by the plurality of rigidity adjusting members 12.

In addition, in the body 2 of the electric guitar 1 of the present embodiment, the rigidity of the body 2 with respect to the torsional mode can be enhanced by integrally forming the plurality of rigidity adjusting members 12. This makes it possible to actively increase the natural frequency of the body 2 corresponding to the torsional mode.

In the body 2 of the electric guitar 1 of the present embodiment, the rigidity adjusting member 12 extends from the torsional mode node toward the first end side of the main body 13 to which the neck 3 is connected. Therefore, it is possible to prevent the rigidity adjusting member 12 from being formed so as to spread out from the torsional mode node in the width direction of the main body 13. This makes it possible to suppress an increase in the natural frequency of the body 2 corresponding to the bending mode to a small value while actively increasing the natural frequency of the body 2 corresponding to the torsional mode.

More specifically on this point, displacement of vibration of the body 2 in the bending mode is large at portions on both sides of the torsional mode node in the width direction of the main body 13. In contrast, in the present embodiment, the rigidity adjusting member 12 is formed so as not to reach portions on both sides of the torsional mode node. Therefore, it is possible to prevent the rigidity adjusting members 12 from excessively inhibiting vibration in the bending mode. Thereby it is possible to suppress an increase in the natural frequency of the body 2 corresponding to the bending mode to a small value.

Further, in the body 2 of the electric guitar 1 of the present embodiment, the respective widths W1 and W2 of the rigidity adjusting members 12 are equal to or greater than half of the widths W3 and W4 of the protrusions 14 and equal to or less than the widths W3 and W4. Therefore, compared with the case of the widths W1 and W2 of the rigidity adjusting members 12 being smaller than half of the widths W3 and W4 of the protrusions 14, bending deformation of the protrusions 14 with respect to the main body 13 can be effectively suppressed.

With these effects, it is possible to improve the sound quality of the electric guitar 1 provided with the body 2.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

In the present invention, when the body unit has a plurality of protrusions, the number of the rigidity adjusting members may for example be smaller than the number of the protrusions. That is, the rigidity adjusting member may extend from the torsional mode node in the body portion to for example one or some of the plurality of protrusions. For example, when there are three protrusions, two rigidity adjusting members may respectively extend to two of the protrusions, or one rigidity adjusting member may extend to one protrusion.

In the present invention, the rigidity adjusting member may be embedded in, for example, the inside of the body unit. In this case, the fixing surface of the body unit with which the contact surface of the rigidity adjusting member makes contact may be inner surfaces of the body unit opposite contact surfaces of the rigidity adjusting member. The inner surface of the body unit opposite the contact surface may also be, for example, a surface orthogonal to the thickness direction of the body unit.

In the present invention, the body unit may have, for example, a cavity inside.

The body of a stringed instrument of the present invention is applicable not only to an electric guitar of the above embodiment but also to any stringed instrument having a body, such as an acoustic guitar.

According to the present invention, it is possible to improve the sound quality of a stringed instrument by improving the vibration characteristics of the body even if a protrusion is formed on the body.

What is claimed is:

1. A body for a stringed instrument that includes a neck attached to the body and a bridge for supporting a plurality of strings extending between a distal end of the neck and the body, the body comprising:

a solid body with a top side, a bottom side, and a distal side where the neck would extend from the solid body, and shaped to provide a first protrusion that extends outwardly from the distal side; and a first rigidity adjusting member affixed to the top side of the solid body and extending from top-side area of the solid body, where the bridge would be disposed, to the first protrusion.

2. The body according to claim 1, wherein a torsional mode node of the solid body is located at the top-side area, which is a central portion of the solid body.

3. The body according to claim 1, wherein the first rigidity adjusting member is harder than the solid body, and is made of fiber-reinforced member containing fibers, with a direction of the fibers being oriented in an extension direction of the first rigidity adjusting member.

4. The body according to claim 1, wherein:

the solid body is shaped to provide a second protrusion that extends outwardly on the distal side; and second rigidity adjusting member affixed to the top side of the solid body and extending from the top-side area of the solid body to the second protrusion.

5. The body according to claim 4, wherein the first and second rigidity adjusting members are integrally formed.

6. The body according to claim 1, wherein:

a first width of the first rigidity adjusting member, where the first width is orthogonal to a thickness of the solid body, is equal to or greater than half a second width of the first protrusion, and the second width extends along a boundary between the first protrusion and another portion of the solid body and orthogonal to the thickness direction of the solid body.

7. The body according to claim 5, wherein the first and second rigidity adjusting members form a V-shape, with the first rigidity adjusting member providing one leg of the V-shape and the second rigidity adjusting member providing another leg of the V-shape.

8. The body according to claim 5, further comprising:

a connecting member joining the first and second rigidity adjusting members form a Y-shape, wherein the connecting member is affixed to the top side of the solid body and extends from the top-side area where the bridge would be disposed to a side opposite the distal side where the neck attaches to the solid body, and wherein the connecting member and the first and second rigidity adjusting members are integrally formed.

9. A body for a stringed instrument that includes a neck attached to the body and a bridge for supporting a plurality of strings extending between a distal end of the neck and the body, the body comprising:

a solid body with a top side, a bottom side, and a distal side where the neck would extend from the solid body, and shaped to provide a protrusion that extends outwardly from the distal side; and a rigidity adjusting member affixed to the top side of the solid body and extending from a top-side area of the solid body where the bridge would be disposed, to the protrusion, to suppress bending deformation of the protrusion.

10. A stringed instrument comprising:

a solid body with a top side, a bottom side, and a distal side, and shaped to provide a protrusion that extends outwardly from the distal side;

a neck extending from the distal side of the solid body for supporting a plurality of strings extending between a distal end portion of the neck and a bridge; and a rigidity adjusting member affixed to the top side of the solid body and extending from a top-side area of the solid body where the bridge is disposed, to the protrusion.

* * * * *